US008607720B1

(12) United States Patent
Gardner et al.

(10) Patent No.: US 8,607,720 B1
(45) Date of Patent: Dec. 17, 2013

(54) APPARATUSES AND METHODS FOR POSITIONING AN EMBROIDERY PATTERN ON AN EMBROIDERABLE

(71) Applicants: Gary Allen Gardner, Dallas, TX (US); Claude Brent Taylor, Davidson, NC (US); Susan Williams Ritchie, Stow, OH (US)

(72) Inventors: Gary Allen Gardner, Dallas, TX (US); Claude Brent Taylor, Davidson, NC (US); Susan Williams Ritchie, Stow, OH (US)

( * ) Notice: Subject to any disclaimer, the term of this patent is extended or adjusted under 35 U.S.C. 154(b) by 0 days.

(21) Appl. No.: 13/663,386

(22) Filed: Oct. 29, 2012

(51) Int. Cl.
*D05C 7/04* (2006.01)

(52) U.S. Cl.
USPC ..... 112/103

(58) Field of Classification Search
USPC ..... 112/103, 104, 114, 115, 119, 475.11, 112/470.13, 470.14, 475.05
See application file for complete search history.

(56) References Cited

U.S. PATENT DOCUMENTS

| | | | | |
|---|---|---|---|---|
| 5,934,210 | A * | 8/1999 | Lucchese | 112/103 |
| 6,216,617 | B1 * | 4/2001 | Burt, Jr. | 112/103 |
| 6,725,559 | B2 * | 4/2004 | Burt, Jr. | 33/653 |
| 7,350,678 | B1 * | 4/2008 | Austin | 223/72 |

* cited by examiner

*Primary Examiner* — Tejash Patel

(74) *Attorney, Agent, or Firm* — Afghani Law Firm; Kevin Afghani

(57) ABSTRACT

Apparatuses and methods for positioning an embroidery pattern are provided. According to an illustrative embodiment, an apparatus for positioning an embroidery pattern includes a central edge adapted to be positioned adjacent a centerline of an embroiderable, and an outer edge comprising a set of first, embroidery-positioning points. The set of first points is adapted to receive an adjacent marking to indicate a starting point for embroidering an embroidery pattern on the embroiderable.

20 Claims, 5 Drawing Sheets

APPARATUSES AND METHODS FOR POSITIONING AN EMBROIDERY PATTERN ON AN EMBROIDERABLE

TECHNICAL FIELD

The illustrative embodiments relate generally to embroidery positioning, and more particularly, to apparatuses and methods for positioning an embroidery pattern on an embroiderable.

BACKGROUND

Embroiderables, such as shirts, garments, and other substrates, are often embroidered with an embroidery pattern for aesthetic or functional purposes. While the locations at which an embroidery pattern may be placed on an embroiderable may vary, it is often desired to position an embroidery pattern at a specific location. For example, embroidery patterns are often placed on the right or left chest portion of a shirt. However, current embroidery systems and methods fail to consistently or accurately position embroidery patterns at specific locations of an embroiderable, such as on the right or left chest portion of a shirt. Current systems and methods may also fail to consistently or accurately position embroidery patterns over a pocket, such as a shirt pocket.

SUMMARY

According to an illustrative embodiment, an apparatus for positioning an embroidery pattern includes a central edge adapted to be positioned adjacent a centerline of an embroiderable, and an outer edge comprising a set of first, embroidery-positioning points. The set of first points is adapted to receive an adjacent marking to indicate a starting point for embroidering an embroidery pattern on the embroiderable.

According to another illustrative embodiment, a method for positioning an embroidery pattern includes positioning a central edge of an embroidery positioning device adjacent a centerline of an embroiderable, and marking the embroiderable adjacent one of a set of first, embroidery-positioning points located at an outer edge of the embroidery positioning device. The marking indicates a starting point for embroidering an embroidery pattern on the embroiderable.

According to another illustrative embodiment, an apparatus for positioning an embroidery pattern above a pocket of an embroiderable, the pocket having an open edge, includes a pocket-faceable edge adapted to be positioned adjacent the open edge of the pocket. The pocket-faceable edge substantially centered above the pocket. The pocket-faceable edge has a midpoint. The apparatus also includes a central marking edge positioned substantially perpendicular to the pocket-faceable edge. The central marking edge is further positioned substantially at the midpoint of the pocket-faceable edge. The central marking edge is adapted to receive an adjacent marking to indicate a starting point for embroidering the embroidery pattern on the embroiderable.

According to another illustrative embodiment, a method for positioning an embroidery pattern above a pocket of an embroiderable includes centering a pocket-faceable edge of a pocket embroidery positioning device adjacent an open edge of the pocket on the embroiderable. The pocket-faceable edge has a midpoint. The method also includes marking the embroiderable adjacent a central marking edge of the pocket embroidery positioning device. The central marking edge is positioned substantially perpendicular to the pocket-faceable edge. The central marking edge is further positioned substantially at the midpoint of the pocket-faceable edge. The marking indicates a starting point for embroidering the embroidery pattern on the embroiderable.

DETAILED DESCRIPTION

Figure 1:
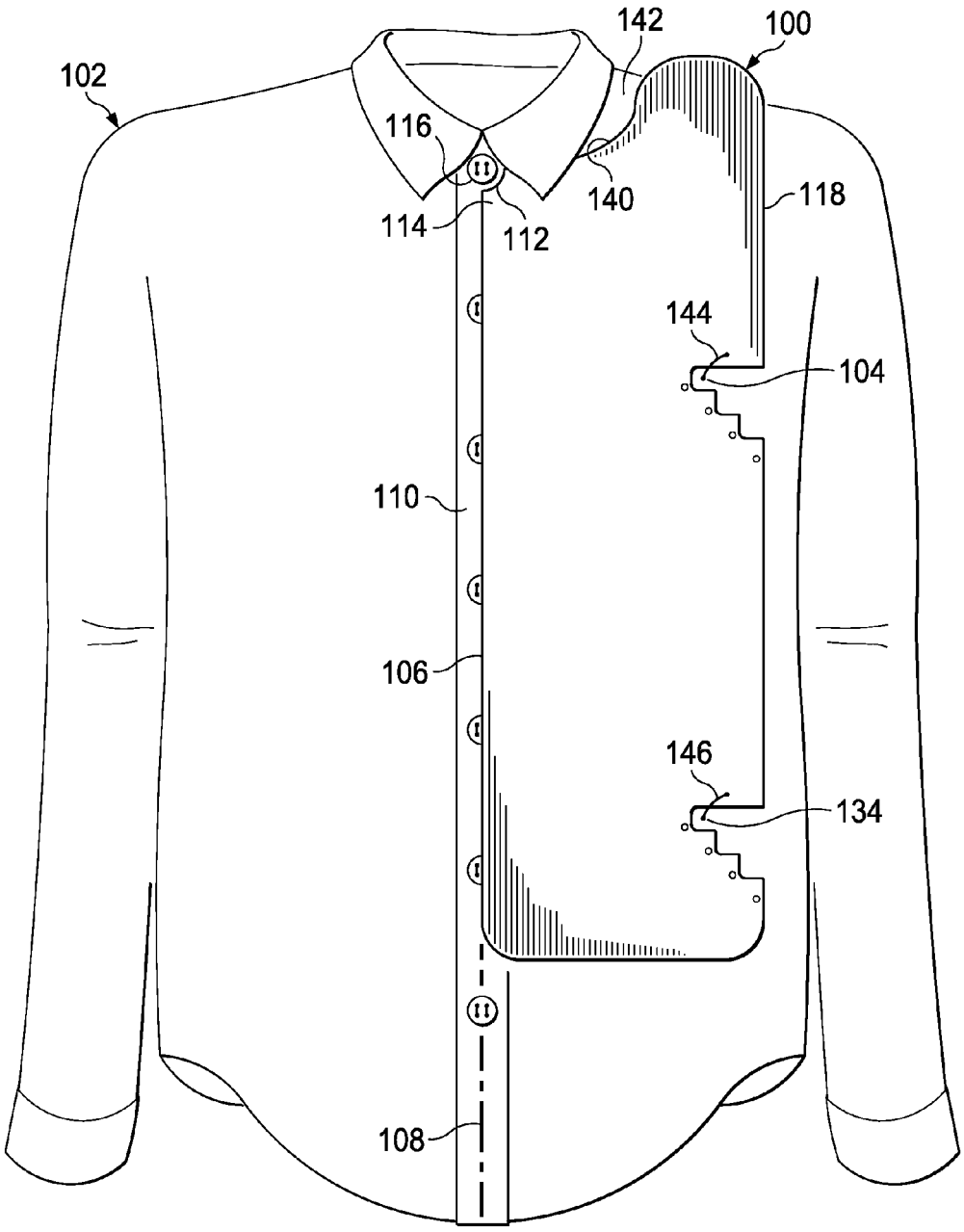
FIG. 1 is a schematic, pictorial representation of an embroidery positioning device being implemented on a shirt according to an illustrative embodiment.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Referring to FIGS. 1 through 4, an illustrative embodiment of an embroidery positioning device 100 is being used to position an embroidery pattern 101 on an embroiderable 102. In particular, the embroidery positioning device 100 may be used to mark a starting point 104 on the embroiderable 102 for embroidering the embroidery pattern 101. The starting point 104 may be used to indicate a point at which an embroidery machine may begin embroidering the embroidery pattern 101. By way of non-limiting example, after marking the starting point 104 for the embroidery to begin, the embroiderer may apply an embroidery hoop to a shirt surrounding the area to be embroidered. The mark 104 may provide a readily visible reference point for the embroiderer to "center", or otherwise align or position, the embroidery hoop. Thus, the marking point 104 provided by the embroidery positioning device 100 may provide a visual reference point to facilitate centering the embroidery hoop for the embroiderer. It will be appreciated that the ability to consistently determine the same starting point may be useful when embroiderers are embroidering multiple shirts for a client or project and the embroidered logo or design is desired to be in the same location.

In the non-limiting example of FIGS. 1 through 4, the embroiderable 102 is a shirt. However, an embroiderable may include any material capable of being sewn, embroidered, or otherwise threaded in any fashion, including, but not limited to, fabric, stabilizer, paper, etc. A fabric may be composed of any type of material or substance capable of being sewn, embroidered, or otherwise threaded in any fashion, including, but not limited to, cloth, cotton, polyester, leather, synthetic material, vinyl, plastics, etc. Unless otherwise indicated, as used herein, "or" does not require mutual exclusivity.

In one embodiment, the embroidery positioning device 100 includes a central edge 106. The central edge 106 may be positioned adjacent a centerline 108 of the embroiderable 102 when the embroidery positioning device 100 is being used to position the embroidery pattern 101. The manner by which the central edge 106 may be positioned on the embroiderable 102 may depend on the type of embroiderable 102. In the non-limiting example of FIGS. 1 through 4, the embroiderable 102 is a shirt that has a placket 110. On such a shirt, the central edge 106 may be positioned adjacent and substantially parallel to the placket 110 of the shirt.

The embroidery positioning device 100 may also include a button indent 112 located at a top corner region 114 of the central edge 106. The button indent 112 may be used on shirts having one or more buttons. In the case of the shirt shown in FIGS. 1 and 4, the shirt includes multiple buttons along the centerline 108 of the shirt, including a top button 116. The button indent 112 may at least partially receive the top button 116 of the shirt to provide proper alignment or positioning of the embroidery positioning device 100 relative to the shirt when positioning the embroidery pattern 101.

In another embodiment, the shirt on which the embroidery positioning device 100 is used may lack a placket. In this case, the shirt may be foldable along its centerline, and the central edge 106 may be positioned adjacent and substantially parallel to the folded centerline of the shirt. Examples of such shirts lacking a placket may include T-shirts, sweatshirts, etc.

The embroidery positioning device 100 may also include an outer edge 118 that is opposite the central edge 106. As will be described in detail below, the outer edge 118 may include one or more points or indents at various locations that allow a user to place one or more markings on the embroiderable 102 that indicate a starting point for the embroidery pattern 101 or facilitate alignment of the embroiderable 102 in an embroidery hoop or frame.

In one embodiment, the outer edge 118 includes a set of first, embroidery-positioning points 120, 121, 122, 123. As used herein, including in the claims, the term "set" encompasses a quantity of one or more. The set of first points 120, 121, 122, 123 may receive an adjacent marking 104 to indicate a starting point 104 for embroidering the embroidery pattern 101 on the embroiderable 102.

Each of the set of first points 120, 121, 122, 123 may be associated with a different embroiderable size such that the marking 104 may be placed adjacent the particular point 120, 121, 122, 123 that is associated with the size of the embroiderable 102. For example, if the shirt is small-sized, the adjacent marking 104 may be placed adjacent the first embroidery-positioning point 120. By way of further example, if the embroiderable 102 is medium-sized, the marking 104 may be placed adjacent the second embroidery-positioning point 121. If the embroiderable 102 is large-sized, the marking 104 may be placed adjacent the third embroidery-positioning point 122. If the embroiderable 102 is extra large-sized, the marking 104 may be placed adjacent the fourth embroidery positioning point 123. The first points 120, 121, 122, 123 may coincide with different sizes of the embroiderable 102 to more accurately or properly place the starting point 104 at a desirable position for the embroidery pattern 101 to be embroidered.

In one embodiment, the first points 120, 121, 122, 123 may include one or more indents 124, 126, 128 that may receive the adjacent marking 104 to indicate the starting point 104 for embroidering the embroidery pattern 101 on the embroiderable 102. Each of the first indents 124, 126, 128 may have a different depth and be associated with a different embroiderable size, such as in the manner described above.

In one embodiment, the set of first points 120, 121, 122, 123 includes a first embroidery-positioning indent 124 that receives the marking 104 to indicate the starting point 104 for embroidering the embroidery pattern 101 on a small-sized embroiderable. The set of first points 120, 121, 122, 123 may also include a second embroidery-positioning indent 126 that is adapted to receive an adjacent marking 104 to indicate the starting point 104 for embroidering the embroidery pattern 101 on a medium-sized embroiderable. The first embroidery-positioning indent 124 may be deeper than the second embroidery-positioning indent 126. The set of first points 120, 121, 122, 123 may also include a third embroidery-positioning indent 128 that receives the marking 104 to indicate the starting point 104 for embroidering the embroidery pattern 101 on a large-sized embroiderable. The second embroidery-positioning indent 126 may be deeper than the third embroidery-positioning indent 128. The set of first points 120, 121, 122, 123 may also include the fourth embroidery-positioning point 123 that receives an adjacent marking 104 to indicate a starting point 104 for embroidering the embroidery pattern 101 on an extra large-sized embroiderable. It will be appreciated that the depths and number of first points 120, 121, 122, 123 and/or first indents 124, 126, 128 may vary, and are not limited to those shown in FIGS. 1 through 4.

In one embodiment, the outer edge 118 of the embroidery positioning device 100 may include a set of second, aligning points 130, 131, 132, 133 that may be adapted to receive a second adjacent marking 134 to facilitate aligning the embroiderable 102 in an embroidery hoop or frame (not shown). When hooping or framing an embroiderable 102, it may be important to "square", align, or otherwise position the embroiderable 102 in the embroidery hoop in a particular manner. When the embroiderable 102 is a shirt having a placket, the placket may be used as a reference point to align the embroidery hoop around the starting point 104. However, some embroiderables, such as T-shirts and sweatshirts, do not have a placket or other suitable reference points. In these, as well as other, cases, the second points 130, 131, 132, 133 may be used to create the second marking 134, which, in combination with the marking 104, may be used to align or square the embroiderable 102 in an embroidery hoop. It will be appreciated that the embroidery positioning device 100 may be used to hoop or frame embroiderables in any type of embroidery hoop, including home-use embroidery hoops, commercial-use embroidery hoops, and embroidery hoops having any numbers of brackets (e.g., 0, 1, 2, 4, etc.) in any position.

Like the set of first points 120, 121, 122, 123, the second points 130, 131, 132, 133 may each be associated with a different embroiderable size (e.g., first aligning point 130 associated with a small size, second aligning point 131 associated with a medium size, third aligning point 132 associated with a large size, and fourth aligning point 133 associated with an extra large size), and the second marking 134 may be made adjacent one of the second points 130, 131, 132, 133 based on the size of the embroiderable 102.

The set of second points 130, 131, 132, 133 may include one or more second, aligning indents 136, 137, 138 that are adapted to receive the second adjacent marking 134 that facilitates aligning the embroiderable 102 in the embroidery hoop. Each of the second indents 136, 137, 138 may have a different depth, and may be associated with a different embroiderable size. For example, the first aligning indent 136 may receive the second adjacent marking 134 when the embroiderable 102 is a small size, the second aligning indent 137 may receive the second marking 134 when the embroiderable 102 is a medium size, the third aligning indent 138 may receive the second adjacent marking 134 when the embroiderable 102 has a large size, and the fourth aligning point 133, which does not include an indent in this example, may receive the second adjacent marking 134 when the embroiderable 102 is an extra large size.

The set of second points 130, 131, 132, 133 may be positioned farther from a top edge 140 of the embroidery positioning device 100 than the set of first points 120, 121, 122, 123. The top edge 140 is adapted to be positioned adjacent a top portion 142 of the embroiderable 102.

In the examples of FIGS. 1 through 4, pins 144, 146 are used to make the first marking 104 and the second marking 134, respectively. However, the markings 104, 134 may be made using any means, such as an ink mark, an indentation, chalk, marker, etc.

Figure 2:
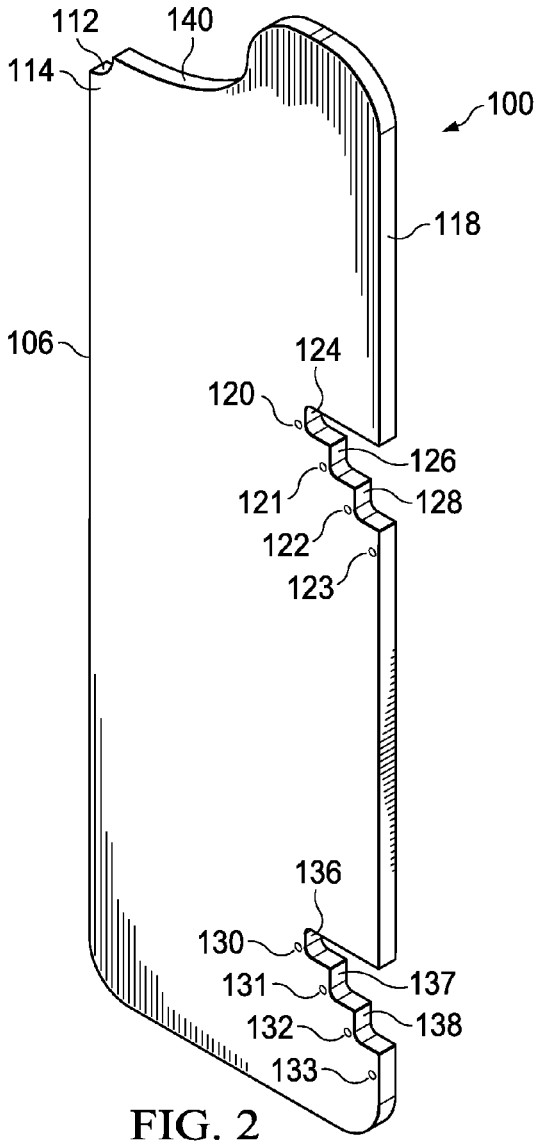
FIG. 2 is a schematic, perspective view of one side of an embroidery positioning device for left chest placement of an embroidery pattern on a shirt according to an illustrative embodiment.
Figure 3:
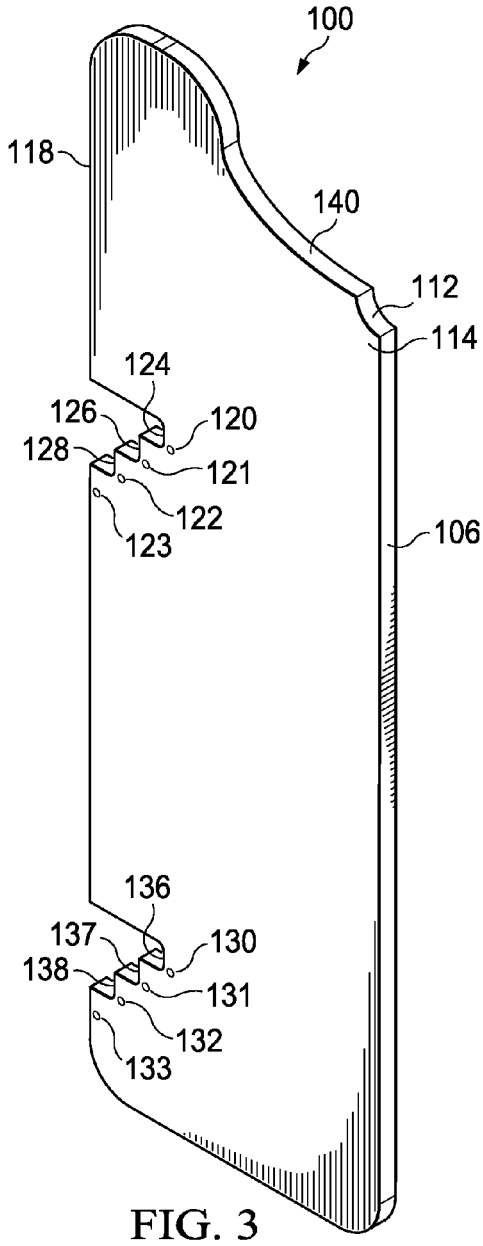
FIG. 3 is a schematic, perspective view of the other side of the embroidery positioning device illustrated in FIG. 2 that is usable for right chest placement of an embroidery pattern on a shirt according to an illustrative embodiment.
Figure 4:
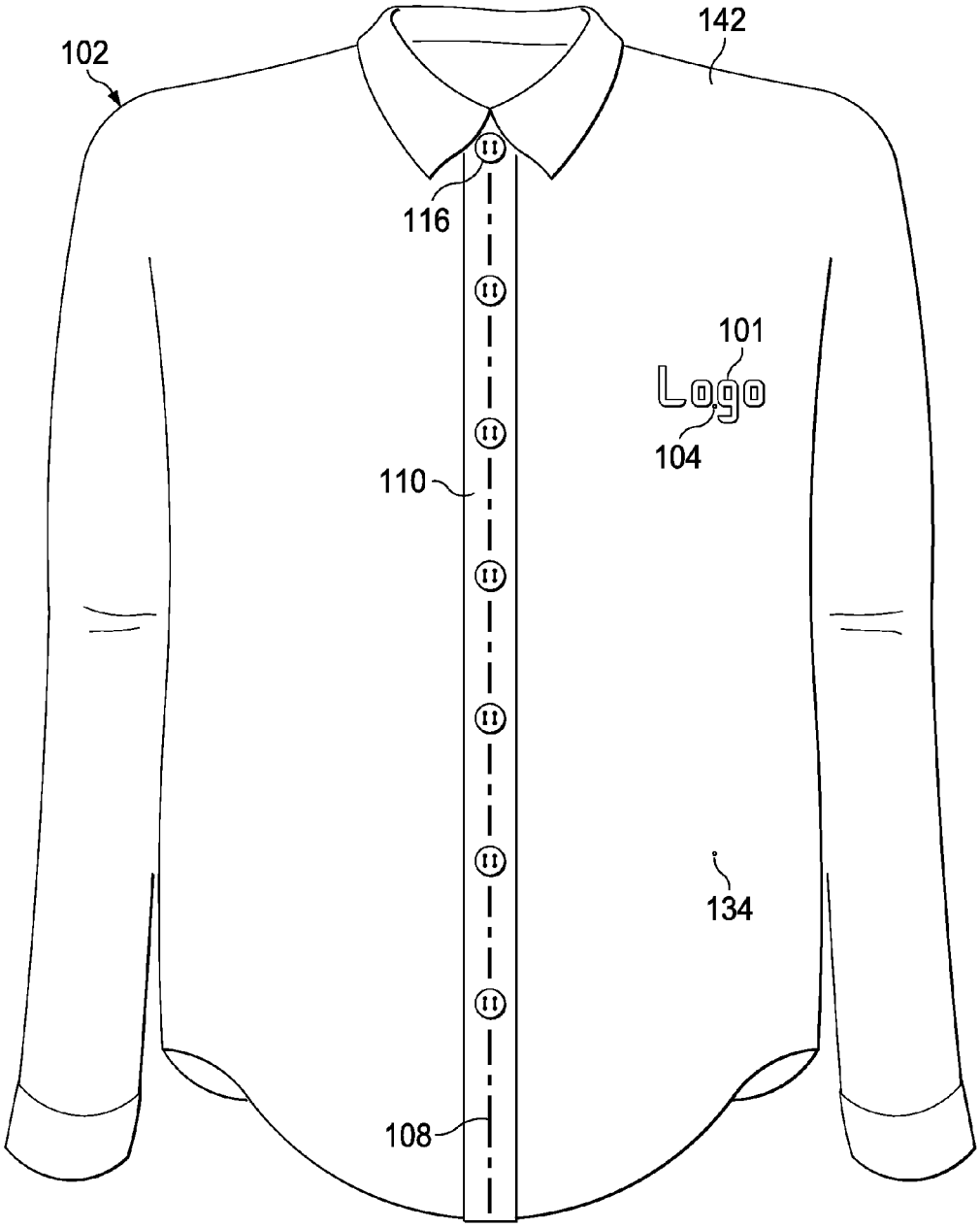
FIG. 4 is a schematic, pictorial representation of a shirt on which an embroidery pattern has been sewn using the embroidery positioning device according to an illustrative embodiment.

In a non-limiting example, the side of the embroidery positioning device 100 shown in FIGS. 1 and 2 may be used to mark a starting point on a left chest of a shirt. The side of the embroidery positioning device 100 shown in FIG. 3 may be used to mark a starting point on a right chest of a shirt.

In operation, the central edge 106 of the embroidery positioning device 100 may be positioned adjacent the centerline 108 of the embroiderable 102 (e.g., shirt). As mentioned above, if the shirt lacks a placket, the shirt may be folded along the centerline 108, and the central edge 106 may be positioned adjacent and substantially parallel to the folded centerline 108 of the shirt. On the other hand, if the shirt has a placket 110 and/or one or more buttons including a top button 116, the central edge 106 of the embroidery positioning device 100 may be positioned adjacent and substantially parallel to the placket 110. Furthermore, the button indent 112 may at least partially receive the top button 116.

Next, the embroiderable 102 may be marked adjacent one of the set of first, embroidery-positioning points 120, 121, 122, 123 to indicate the starting point 104 for embroidering the embroidery pattern 101 on the embroiderable 102. As described above, each of the first points 120, 121, 122, 123 may be associated with a different size of the embroiderable 102, and the marking 104 may be made based on the size of the embroiderable 102. In addition, the first points 120, 121, 122, 123 may include one or more indents that are associated with a different size of the embroiderable 102.

To provide a non-limiting example, if the embroiderable 102 is a small-sized shirt, the marking 104 may be made adjacent the first embroidery-positioning point 120, which has the first embroidery-positioning indent 124. The starting point 104 may then be used in an embroidery machine or other device or embroidery method as a reference point for starting the embroidery pattern 101.

In use, the embroiderable 102 may also be marked adjacent one of the second, aligning points 130, 131, 132, 133 to form the second marking 134, which is used to facilitate aligning the embroiderable 102 in an embroidery hoop or frame. Each of the second points 130, 131, 132, 133 may be associated with a different size of the embroiderable 102, and the second marking 134 may be made adjacent one of the second points 130, 131, 132, 133 based on the size of the embroiderable 102. The second points 130, 131, 132, 133 may also include one or more second indents 136, 137, 138 as described above.

To continue the example given above, if the embroiderable 102 is a small-sized shirt, in addition to the marking 104 being made adjacent the first embroidery-positioning indent 124, the second marking 134 may be made at the first aligning indent 136 adjacent the first aligning point 130. The first marking 104 and the second marking 134 thus made on the small-sized embroiderable provides a vertical line of reference that may be used for aligning the embroiderable 102 in an embroidery hoop or frame.

Figure 5:
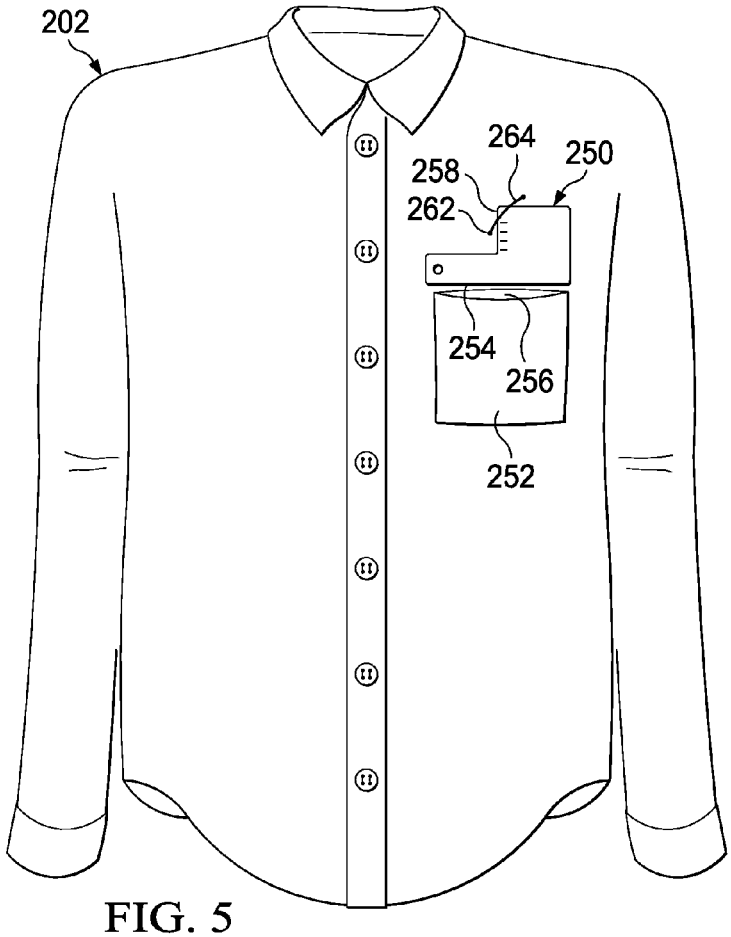
FIG. 5 is a schematic, pictorial representation of a pocket embroidery positioning device being implemented on a shirt according to an illustrative embodiment.
Figure 6:
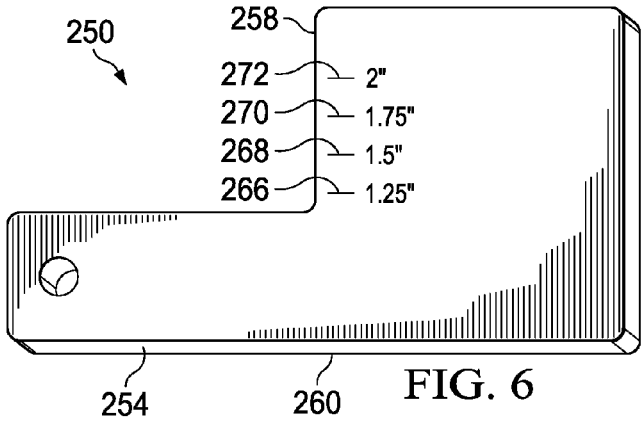
FIG. 6 is a schematic, plan view of a pocket embroidery positioning device according to an illustrative embodiment.

Referring to FIGS. 5 and 6, a pocket embroidery positioning device 250 may be used to position an embroidery pattern above a pocket 252 of an embroiderable 202. Elements of FIGS. 5 and 6 that are analogous to elements in FIGS. 1 through 4 have been shown by indexing the reference numerals by 100. The pocket embroidery positioning device 250 may include a pocket-faceable edge 254 that may be positioned adjacent the open edge 256 of the pocket 252. In particular, the pocket-faceable edge 254 may be positioned to be substantially centered above the pocket 252.

The pocket embroidery positioning device 250 may also include a central marking edge 258 that is positioned substantially perpendicular to the pocket-faceable edge 254. The central marking edge 258 may be substantially at or aligned with the midpoint 260 of the pocket-faceable edge 254. The central marking edge 258 may receive an adjacent marking 262, using a pin 264 or other technique, to indicate the starting point 262 for embroidering the embroidery pattern on the embroiderable 202. The central marking edge 258 may include one or more height indicators 266, 268, 270, 272 that show a distance from the pocket-faceable edge 254.

In operation, after positioning the pocket embroidery positioning device 250 above the pocket 252 as described above, a height of the embroidery pattern desired to be placed on the embroiderable 202 may be determined. The height of the embroidery pattern may then be divided by 2 to form a halved embroidery pattern height. A desired separation distance between the embroidery pattern and the open edge 254 of the pocket 252 may then be determined by a user. The halved embroidery pattern height may then be added to the desired separation distance to form a starting point distance. The marking 262 may then be made on the embroiderable 202 adjacent the central marking edge 258 at the starting point distance from the pocket-faceable edge 254.

To provide a non-limiting example, the embroidery pattern may be 2 inches in height, in which case the halved embroidery pattern height would be 1 inch. The desired separation distance may be determined by a user to be ½ of an inch. The desired separation distance of ½ of an inch may then be added to the halved embroidery pattern height of 1 inch to equal 1½ inches. The embroiderable 202 may then be marked adjacent the second height indicator 268 that is 1½ inches from the pocket-faceable edge 254.

The marking 262 may then be used as the starting point to embroider the embroidery pattern on the embroiderable 202. It will be appreciated that any number of height indicators may be on the pocket embroidery positioning device 250, at any increment.

Figure 7:
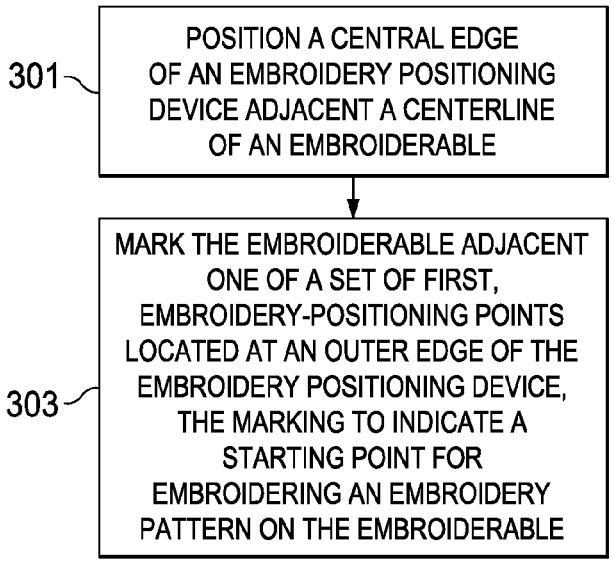
FIG. 7 is a flowchart of a process for positioning an embroidery pattern on an embroiderable according to an illustrative embodiment.

Referring to FIG. 7, a process for positioning an embroidery pattern on an embroiderable includes positioning a central edge of an embroidery positioning device adjacent a centerline of an embroiderable (step 301). The process may also include marking the embroiderable adjacent one of a set of first, embroidery-positioning points located at an outer edge of the embroidery positioning device (step 303). The marking may indicate a starting point for embroidering an embroidery pattern on the embroiderable.

Figure 8:
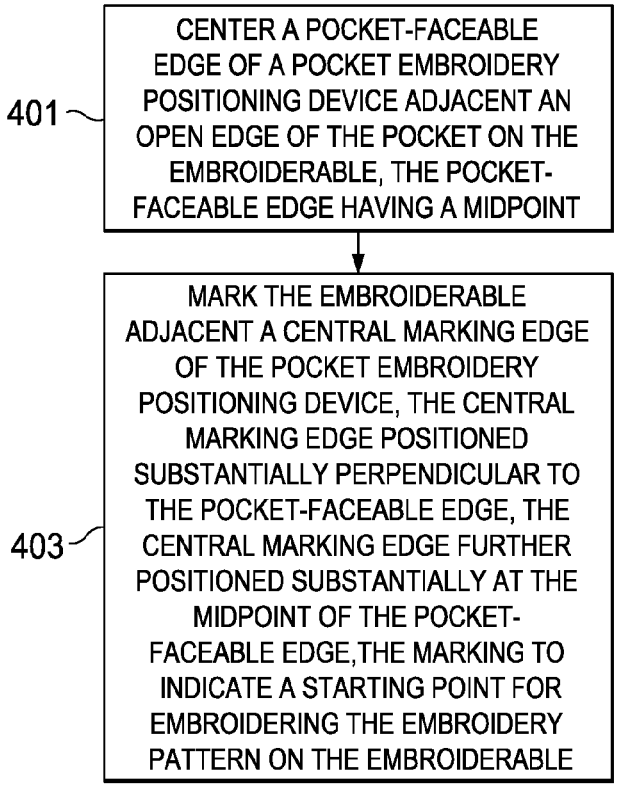
FIG. 8 is a flowchart of a process for positioning an embroidery pattern above a pocket of an embroiderable according to an illustrative embodiment.

Referring to FIG. 8, a process for positioning an embroidery pattern above a pocket of an embroiderable includes centering a pocket-faceable edge of a pocket embroidery positioning device adjacent an open edge of the pocket on the embroiderable (step 401). The pocket-faceable edge may have a midpoint. The process may also include marking the embroiderable adjacent a central marking edge of the pocket embroidery positioning device (step 403). The central marking edge may be positioned substantially perpendicular to the pocket-faceable edge. The central marking edge may further be positioned substantially at the midpoint of the pocket-faceable edge. The marking may indicate a starting point for embroidering the embroidery pattern on the embroiderable.

The flowcharts and block diagrams in the different depicted embodiments illustrate the architecture, functionality, and operation of some possible implementations of apparatus, methods and computer program products. In this regard, each block in the flowchart or block diagrams may represent a module, segment, or portion of code, which comprises one or more executable instructions for implementing the specified function or functions. In some alternative implementations, the function or functions noted in the block may occur out of the order noted in the Figures. For example, in some cases, two blocks shown in succession may be executed substantially concurrently, or the blocks may sometimes be executed in the reverse order, depending upon the functionality involved.

As used herein, including in the claims, the terms first, second, third, etc. . . . used in relation to an element (e.g., first point, second point, etc.) are for reference or identification purposes only, and these terms, unless otherwise indicated, are not intended to describe or suggest a number, order, source, purpose, or substantive quality for any element for which such a term is used.

Although the illustrative embodiments described herein have been disclosed in the context of certain illustrative, non-limiting embodiments, it should be understood that various changes, substitutions, permutations, and alterations can be made without departing from the scope of the invention as defined by the appended claims. It will be appreciated that any feature that is described in a connection to any one embodiment may also be applicable to any other embodiment.

What is claimed is:

1. An apparatus for positioning an embroidery pattern, the apparatus comprising:

a central edge adapted to be positioned adjacent a centerline of an embroiderable; and an outer edge comprising a set of first, embroidery-positioning points, the set of first points adapted to receive an adjacent marking to indicate a starting point for embroidering an embroidery pattern on the embroiderable;

wherein the set of first points comprises one or more first indents adapted to receive the adjacent marking to indicate the starting point for embroidering the embroidery pattern on the embroiderable.

2. The apparatus of claim 1, wherein the one or more first indents is a plurality of first indents.

3. The apparatus of claim 2, wherein each of the plurality of first indents has a different depth; and wherein each of the plurality of first indents is associated with a different embroiderable size.

4. The apparatus of claim 1, wherein the set of first points comprises:

a first embroidery-positioning indent adapted to receive the adjacent marking to indicate the starting point for embroidering the embroidery pattern on a small-sized embroiderable;

a second embroidery-positioning indent adapted to receive the adjacent marking to indicate the starting point for embroidering the embroidery pattern on a medium-sized embroiderable, the first embroidery-positioning indent deeper than the second embroidery-positioning indent;

a third embroidery-positioning indent adapted to receive the adjacent marking to indicate the starting point for embroidering the embroidery pattern on a large-sized embroiderable, the second embroidery-positioning indent deeper than the third embroidery-positioning indent; and an embroidery-positioning point adapted to receive the adjacent marking to indicate the starting point for embroidering the embroidery pattern on an extra large-sized embroiderable.

5. The apparatus of claim 1, wherein the embroiderable is a shirt.

6. The apparatus of claim 5, wherein the shirt comprises a placket; and wherein the central edge is adapted to be positioned adjacent and substantially parallel to the placket of the shirt.

7. The apparatus of claim 5, wherein the shirt lacks a placket and is foldable along the centerline; and wherein the central edge is adapted to be positioned adjacent and substantially parallel to the folded centerline of the shirt.

8. The apparatus of claim 5, wherein the central edge comprises a top corner region;

wherein the shirt comprises a plurality of buttons located along the centerline of the shirt, the plurality of buttons comprising a top button; and wherein the top corner region of the central edge comprises a button indent adapted to at least partially receive the top button of the shirt.

9. An apparatus for positioning an embroidery pattern, the apparatus comprising:

a central edge adapted to be positioned adjacent a centerline of an embroiderable; and an outer edge comprising a set of first, embroidery-positioning points, the set of first points adapted to receive an adjacent marking to indicate a starting point for embroidering an embroidery pattern on the embroiderable;

wherein the outer edge further comprises a set of second, aligning points, the set of second points adapted to receive a second adjacent marking to facilitate aligning the embroiderable in an embroidery hoop; and wherein the set of second points comprises one or more second indents adapted to receive the second adjacent marking to facilitate aligning the embroiderable in the embroidery hoop.

10. The apparatus of claim 9, wherein the one or more second indents is a plurality of second indents.

11. The apparatus of claim 10, wherein each of the plurality of second indents has a different depth; and wherein each of the plurality of second indents is associated with a different embroiderable size.

12. The apparatus of claim 9, wherein the set of second points comprises:

a first aligning indent adapted to receive the second adjacent marking to facilitate aligning a small-sized embroiderable in the embroidery hoop;

a second aligning indent adapted to receive the second adjacent marking to facilitate aligning a medium-sized embroiderable in the embroidery hoop, the first aligning indent deeper than the second aligning indent;

a third aligning indent adapted to receive the second adjacent marking to facilitate aligning a large-sized embroiderable in the embroidery hoop, the second aligning indent deeper than the third aligning indent; and an aligning point adapted to receive the second adjacent marking to facilitate aligning an extra large-sized embroiderable in the embroidery hoop.

13. The apparatus of claim 1, wherein the set of first points comprises:

a first embroidery-positioning indent adapted to receive the adjacent marking to indicate the starting point for embroidering the embroidery pattern on a small-sized embroiderable;

a second embroidery-positioning indent adapted to receive the adjacent marking to indicate the starting point for embroidering the embroidery pattern on a medium-sized embroiderable, the first embroidery-positioning indent deeper than the second embroidery-positioning indent;

a third embroidery-positioning indent adapted to receive the adjacent marking to indicate the starting point for embroidering the embroidery pattern on a large-sized embroiderable, the second embroidery-positioning indent deeper than the third embroidery-positioning indent; and an embroidery-positioning point adapted to receive the adjacent marking to indicate the starting point for embroidering the embroidery pattern on an extra large-sized embroiderable;

wherein the outer edge further comprises a set of second, aligning points, the set of second points adapted to receive a second adjacent marking to facilitate aligning the embroiderable in an embroidery hoop, the set of second points comprising:

a first aligning indent adapted to receive the second adjacent marking to facilitate aligning the small-sized embroiderable in the embroidery hoop;

a second aligning indent adapted to receive the second adjacent marking to facilitate aligning the medium-sized embroiderable in the embroidery hoop, the first aligning indent deeper than the second aligning indent;

a third aligning indent adapted to receive the second adjacent marking to facilitate aligning the large-sized embroiderable in the embroidery hoop, the second aligning indent deeper than the third aligning indent; and an aligning point adapted to receive the second adjacent marking to facilitate aligning the extra large-sized embroiderable in the embroidery hoop;

wherein the embroiderable has a top portion;

wherein the apparatus has a top edge adapted to be positioned adjacent the top portion of the embroiderable; and wherein the set of first points is closer to the top edge than the set of second points.

14. A method for positioning an embroidery pattern, the method comprising:

positioning a central edge of an embroidery positioning device adjacent a centerline of an embroiderable; and marking the embroiderable adjacent one of a set of first, embroidery-positioning points located at an outer edge of the embroidery positioning device, the marking to indicate a starting point for embroidering an embroidery pattern on the embroiderable;

wherein the embroiderable is a shirt having a placket comprising a plurality of buttons, the plurality of buttons including a top button;

wherein positioning the central edge of the embroidery positioning device adjacent the centerline of the embroiderable comprises:

positioning the central edge of the embroidery positioning device adjacent and substantially parallel to the placket; and positioning a button indent, located on the central edge of the embroidery positioning device, to at least partially receive the top button.

15. The method of claim 14, wherein each of the set of first, embroidery-positioning points is associated with a different size of the embroiderable; and wherein marking the embroiderable adjacent one of the set of first points comprises marking the embroiderable adjacent one of the set of first points based on the size of the embroiderable.

16. The method of claim 14, further comprising:

marking the embroiderable adjacent one of a set of second, aligning points located at the outer edge of the embroidery positioning device to form a second marking, the second marking to facilitate aligning the embroiderable in an embroidery hoop.

17. The method of claim 16, wherein each of the set of second, aligning points is associated with a different size of the embroiderable; and wherein marking the embroiderable adjacent one of the set of second points comprises marking the embroiderable adjacent one of the set of second points based on the size of the embroiderable.

18. The method of claim 16, further comprising:

aligning the embroiderable in the embroidery hoop using the marking and the second marking.

19. An apparatus for positioning an embroidery pattern above a pocket of an embroiderable, the pocket having an open edge, the apparatus comprising:

a pocket-faceable edge adapted to be positioned adjacent the open edge of the pocket, the pocket-faceable edge substantially centered above the pocket, the pocket-faceable edge having a midpoint; and a central marking edge positioned substantially perpendicular to the pocket-faceable edge, the central marking edge further positioned substantially at the midpoint of the pocket-faceable edge;

wherein the central marking edge is adapted to receive an adjacent marking to indicate a starting point for embroidering the embroidery pattern on the embroiderable; and wherein the central marking edge comprises one or more height indicators, each of the one or more height indicators showing a distance from the pocket-faceable edge.

20. A method for positioning an embroidery pattern above a pocket of an embroiderable, the method comprising:

centering a pocket-faceable edge of a pocket embroidery positioning device adjacent an open edge of the pocket on the embroiderable, the pocket-faceable edge having a midpoint;

marking the embroiderable adjacent a central marking edge of the pocket embroidery positioning device, the central marking edge positioned substantially perpendicular to the pocket-faceable edge, the central marking edge further positioned substantially at the midpoint of the pocket-faceable edge, the marking to indicate a starting point for embroidering the embroidery pattern on the embroiderable;

determining a height of the embroidery pattern;

dividing the height of the embroidery pattern by 2 to form a halved embroidery pattern height;

determining a desired separation distance between the embroidery pattern and the open edge of the pocket; and adding the halved embroidery pattern height to the desired separation distance to form a starting point distance;

wherein marking the embroiderable adjacent the central marking edge of the pocket embroidery positioning device comprises marking the embroiderable adjacent the central marking edge at the starting point distance from the pocket-faceable edge.

* * * * *